US005418427A

United States Patent [19]

Cipolla et al.

[11] Patent Number: 5,418,427

[45] Date of Patent: May 23, 1995

[54] INTERNALLY COOLED FORWARD WAVE CROSSED FIELD AMPLIFIER ANODE VANE

[75] Inventors: John C. Cipolla, Trout Run; Chris L. Wheeland, Winfield; Guilford R. MacPhail; Joseph C. Musheno, both of Williamsport; James L. Barry, Montoursville, all of Pa.

[73] Assignee: Litton Systems, Inc., Beverly Hills, Calif.

[21] Appl. No.: 890,663

[22] Filed: May 28, 1992

[51] Int. Cl.[6] ..... H01J 23/24; H01J 25/36

[52] U.S. Cl. ..... 315/39.3; 313/32; 313/35

[58] Field of Search ..... 315/39.3, 39.51; 313/22, 32, 35, 36

[56] References Cited

U.S. PATENT DOCUMENTS

| | | | |
|---|---|---|---|
| 2,523,049 | 9/1950 | Nelson | 313/32 X |
| 2,612,623 | 9/1952 | Spencer | 313/32 X |
| 3,250,945 | 5/1966 | Sample | 315/39.3 X |
| 3,320,471 | 5/1967 | Mims | 315/39.3 |
| 3,666,983 | 5/1972 | Krah et al. | 315/3.5 |
| 3,845,341 | 10/1974 | Addoms et al. | 315/5.38 X |
| 4,700,109 | 10/1987 | MacPhail | 315/39.3 |
| 4,831,335 | 5/1989 | Wheeland et al. | 330/47 |
| 4,949,047 | 8/1990 | Hayward et al. | 313/153 X |
| 4,975,656 | 12/1990 | Schaeffer et al. | 330/42 |

FOREIGN PATENT DOCUMENTS

| | | |
|---|---|---|
| 601102 | 4/1948 | United Kingdom . |
| 655409 | 7/1951 | United Kingdom . |
| 675176 | 7/1952 | United Kingdom . |
| 710552 | 6/1954 | United Kingdom . |
| 942685 | 11/1963 | United Kingdom . |
| 1492505 | 11/1977 | United Kingdom . |
| 2056163A | 3/1981 | United Kingdom . |

*Primary Examiner*—Andrew M. Dolinar
*Attorney, Agent, or Firm*—Graham & James

[57] ABSTRACT

The present invention provides a double helix coupled vane forward wave crossed-field amplifier utilizing individually cooled vanes in the RF slow-wave circuit. Specifically, a double helix coupled vane is machined to create a channel in the shape of a "U" on one side of the vane. A vane coolant tube formed in a corresponding U-shape is inserted and brazed to the machined vane. The vane assembly is then attached to the anode body of which the backwall has holes formed to accept the coolant tubes from each vane. Divided backwall coolant channels are brazed to the outside of the anode, thereby placing in fluid communication the coolant channels to the vane coolant tube. Accordingly, coolant is cycled through each vane tube and individual vanes of the anode are thus cooled.

17 Claims, 3 Drawing Sheets

FIG. 2
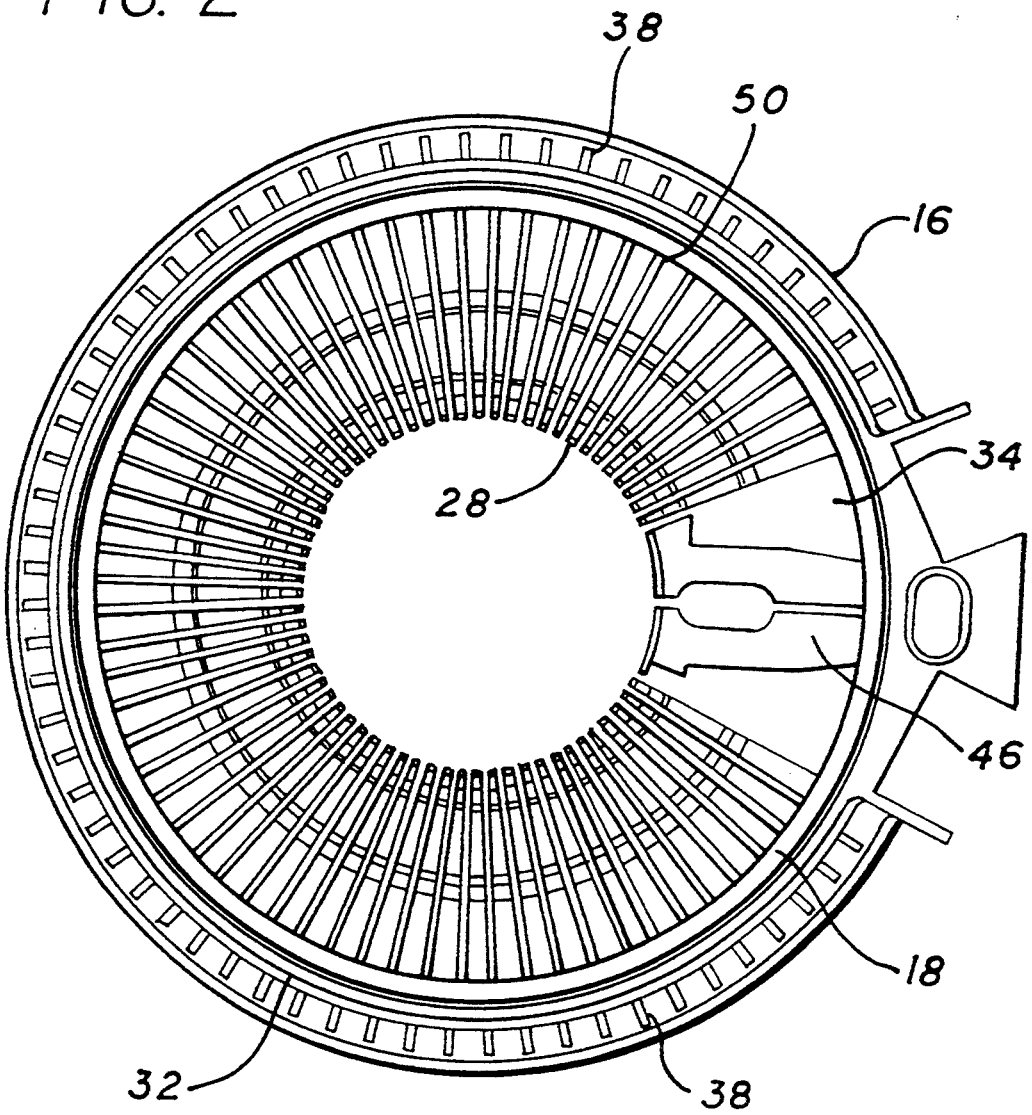
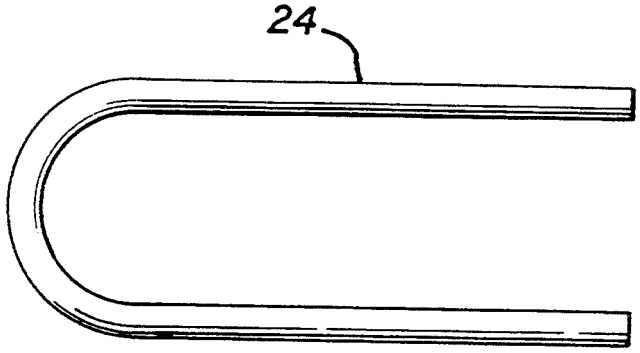
FIG. 3

INTERNALLY COOLED FORWARD WAVE CROSSED FIELD AMPLIFIER ANODE VANE

GOVERNMENT CONTRACT

This invention has been developed under contract with the United States Government, Contract No. A8087-S3.

BACKGROUND OF THE INVENTION

1. Field of the Invention

The present invention relates to crossed-field amplifiers, and more precisely, to a crossed-field amplifier using internally cooled forward wave anode vanes.

2. Description of the Related Art

Crossed-field amplifiers (CFAs) have been used for several years in electronic systems that require high RF power, such as radar systems. A CFA operates by passing an RF signal through a high voltage electric field formed between a cathode and an anode. The cathode emits electrons which interact with an RF wave as it travels through a slow-wave path provided in the anode structure surrounding the cathode. The RF wave is guided by a magnetic field, which crosses the electric field perpendicularly.

Traditionally, the cathode in such an amplifier is based on a thermionic-type emitter that operates on a principle of direct heating to boil off electrons. Non-thermionic emitter cathodes are also available. These cathodes are formed from pure metal, such as molybdenum, platinum or nickel, which emits secondary electrons due to bombardment of the metal with primary electrons. Since there is no cathode heating, the non-thermionic emitter cathodes have improved life capability over thermionic emitter cathodes.

The anode structure comprises a plurality of vanes disposed coaxially around the cathode. When electrons leave the cathode of the CFA in a direction perpendicular to the magnetic field, the field causes a force to act at right angles to the electron motion. The electrons then spiral into orbit around the cathode instead of moving with the electric field. Most of the electrons gradually move toward the anode, giving up potential energy to the RF wave as they interact with the anode slow-wave structure.

However, a problem with crossed-field amplifiers is their relatively short life span, especially when operated at high average power. To impart the energy into the RF wave, there must be high electron discharge into the anode structure that generates heat build-up. At high power levels, the electron discharge can damage the anode vanes and the protective molybdenum coating on the vane tips can burn off.

To rectify the problem, liquid cooling systems have been used in conventional crossed-field amplifiers. An example of a liquid cooled crossed-field amplifier is disclosed in U.S. Pat. No. 4,700,109, issued Oct. 13, 1987 to G. R. MacPhail. Usually, oil or water coolant was supplied to the backwall of the anode vanes. But this standard backwall cooled anode design was sometimes inadequate to meet system requirements, since the vane tips are not close enough to the back wall to obtain the beneficial effects of the liquid coolant.

Accordingly, a need presently exists for improved cooling of each vane of a standard double helix coupled vane crossed-field amplifier.

SUMMARY OF THE INVENTION

Therefore, in view of the foregoing, it is an object of the present invention to provide a crossed-field amplifier having improved vane cooling to allow higher average power operation.

In accomplishing this object, the present invention provides a conventional double helix coupled vane forward wave crossed-field amplifier, having internally cooled vanes. The crossed-field amplifier comprises a cathode which emits electrons that travel across a magnetic field established by magnetic polepieces, and then move toward a centrally located anode. The anode is fashioned into the individual vanes having a fin-shape, wherein the vanes are arranged coaxially around the cathode.

Each anode vane is provided with an individual coolant carrying passage to channel a coolant through the vane. More particularly, each vane is machined to create a channel in the shape of a "U". A tube formed in the identical U-shape is placed in the channel and integrally formed with the vane by known techniques, such as brazing. The vanes are secured to an anode structure, which includes a backwall receiving the open ends of each tube. Coolant channels brazed to the outside of the anode allow the coolant to flow from the coolant channel and into and out of the U-shape tube of each vane. The coolant flows along one coolant channel, then in through the U-shape tube of the vane, and finally exits via another coolant channel.

Empirical tests show that a crossed-field amplifier constructed according to the present invention is capable of 150 kilowatts at 3.7 percent duty. This is more than twice the average power capability of conventional double helix coupled vane forward wave crossed-field amplifiers.

A more complete understanding of the internally cooled forward wave crossed-field amplifier anode vane of the present invention will be afforded to those skilled in the art, as well as a realization of additional advantages and objects thereof, by a consideration of the following detailed description of the preferred embodiment. Reference will be made to the appended sheets of drawings, which will first be described briefly.

BRIEF DESCRIPTION OF THE DRAWINGS

FIG. 2 is a plan view of a double helix coupled vane anode structure;

FIG. 3 illustrates a vane tube;

DETAILED DESCRIPTION OF THE PREFERRED EMBODIMENT

The following specification describes a double helix coupled vane forward wave crossed-field amplifier using individual vane cooling, wherein U-shape coolant passages are incorporated into the vanes. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention.

Figure 1:
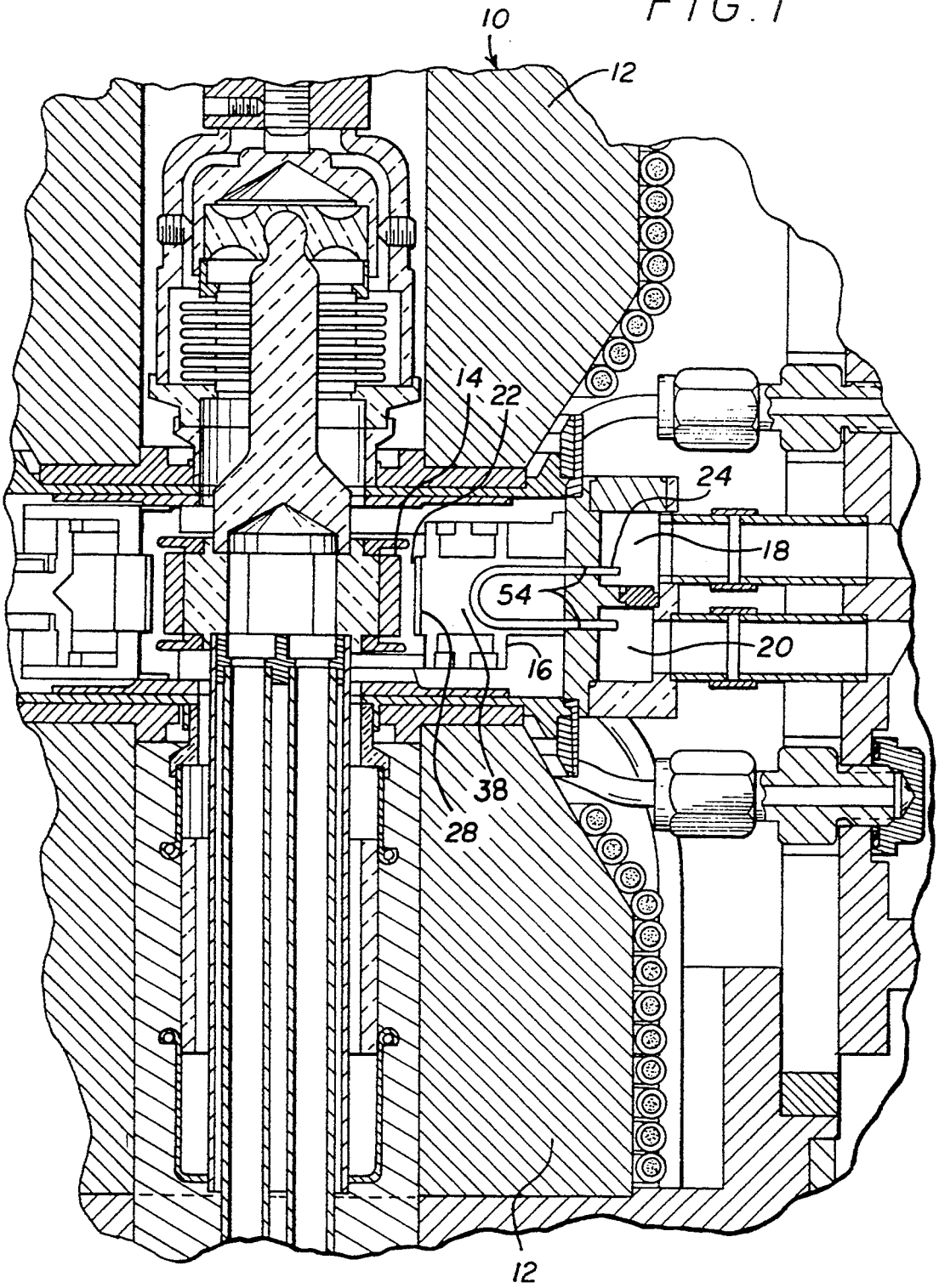
FIG. 1 is a cross-sectional view of a double helix coupled vane forward wave crossed-field amplifier incorporating an internally cooled vane.

FIG. 1 provides a partial cross-sectional view of a conventional double helix coupled vane forward wave crossed-field amplifier 10 designed to operate in the forward wave mode. This preferred embodiment crossed-field amplifier 10 has an annular shape anode structure, generally denoted by reference number 16, which surrounds coaxially a cathode, generally denoted by reference number 14. The cathode 14 is positioned substantially at the center of the annular shape anode 16. Above and below the anode 16 and cathode 14 are permanent magnets 12 that supply a magnetic field.

The cathode 14 is preferably made of beryllium with an oxide coating. The cathode 14 is further comprised of a non-emissive core material and a cathode base of refractory material. Regarding the beryllium oxide cathode emitter, calculations based on geometry and operating points of the tube indicate that a secondary emission ratio of about 2.3 is required. Beryllium oxide is the only secondary emitting material with proven long life capability at this high secondary emission ratio. With the beryllium oxide emitter, an oxygen source within the vacuum envelope is necessary to maintain a surface coating of oxide which otherwise would become depleted due to electron and ion bombardment. Moreover, a 0.2 liter ion pump may optionally be used to monitor and control the internal pressure. Two auxiliary power supplies are used in the preferred embodiment (not shown). The power supplies can be AC or DC, rated at 6 volts, 1.5 amps for the oxygen source and a DC supply; 3.5 kilovolts, 300 micro amps for the ion pump. Both voltages are applied at ground potential.

Electrons emitted from the cathode 14 travel across an interaction space 22, which is co-extensive with a magnetic field established by the permanent magnets 12. Under influence from the magnetic field aligned perpendicular thereto, the electron motion is re-directed from moving directly toward anode 16 to revolving around the cathode 14. As the electrons revolve around the cathode, they interact with the RF output wave and transfer energy to the wave. This amplified RF output wave propagates through input/output couplers 46 of a wave guide assembly attached to an external load.

The anode structure 16 preferably employs a double helix coupled vane design. A top view of the anode 16 is provided in FIG. 2, which only shows the top helix, de-coupled from the bottom helix. Specifically, the anode 16 comprises a slow wave structure that includes a plurality of radially extending vanes 38. Preferably, there should be sixty-two individual vanes 38. As is common in such designs, the vanes 38 are joined to a backwall 32 at a proximal end 50. A drift area 34 having a size of approximately 10 pitches between the input and output couplers 46 is used for the input and output of the RF wave. The advantage of such a large number of vanes and a long drift region is that a large anode area is provided, which correspondingly increases the average power capability of the circuit.

Unique to the present invention is the system for cooling individual vanes 38. As seen in FIG. 1, each vane 38 includes a U-shape vane coolant tube 24. A lower anode coolant input channel 20 located external to the backwall 32 near an outer circumference of the anode 16 supplies a coolant to the tube 24. Efflux of the coolant from the tube 24 travels into an upper anode coolant output channel 18 external to the backwall 32, which directs the flow to a reservoir. Holes 54 are provided through the backwall 32 to allow the coolant tube 24 to reach the input channel 20 and output channel 18. Therefore, the coolant input channel 20 is in fluid communication with the coolant output channel 18 via the U-shape coolant tube 24 located in each vane 38. The coolant reservoir and a pump that drives the coolant system are well-known in the art and so are not shown.

In addition, the coolant channels 18 and 20 extend around an outer circumference of the annular anode structure 16 so that coolant can be cycled through the vane coolant tube 24 of each vane 38. Preferably, the coolant is a 50/50 mixture of ethylene glycol and water.

Thermal analysis and operating test data have determined that conventional backwall cooled anode designs were inadequate to properly control temperatures of a double helix coupled vane forward wave crossed-field amplifier. In the present invention, however, by virtue of the U-shape coolant tube 24 located in each vane 38, a shorter conduction path is established between the circuit vane tip 28 and the liquid coolant channels 18 and 20. The overheating problem is thus rectified by the present invention cooling system.

FIGS. 3 and 4 illustrate construction of a preferred embodiment vane 38 with its U-shape vane coolant tube 24. FIG. 3 shows the preferred embodiment U-shape vane coolant tube 24. The tube 24 is preferably fashioned from a non-magnetic alloy, such as monel, having two legs joined by an arcuate intermediate portion. Of course, other shapes for the tube are possible. Since the basic function of the tube 24 is to deliver coolant directly to each vane, its shape can be varied in accordance with specific cooling and design needs.

Figure 4A:
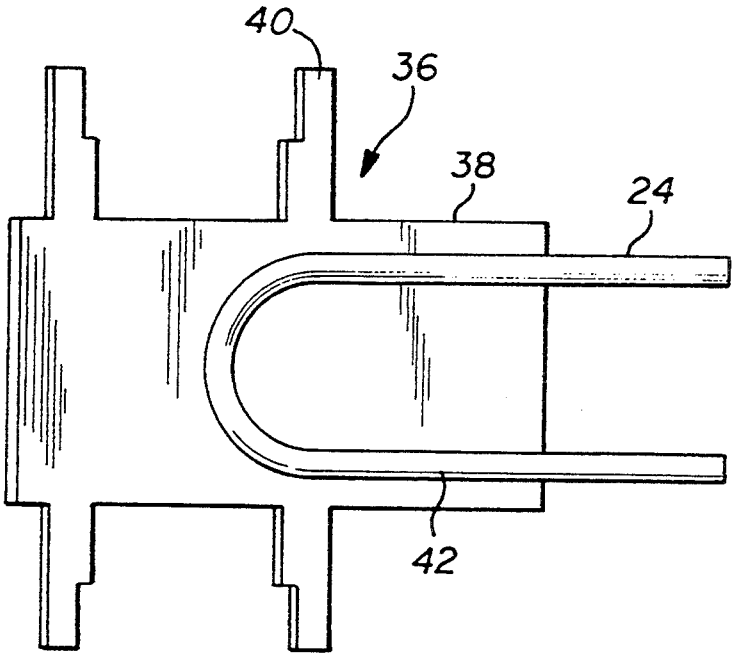
FIG. 4A is a plan view that illustrates a vane assembly wherein the vane tube is inserted into a channel provided in the vane.
Figure 4B:
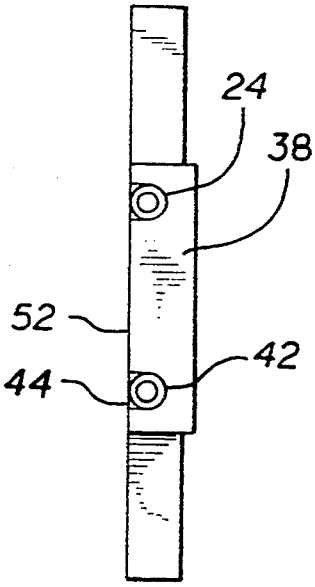
FIG. 4B is an end view of the vane assembly shown in FIG. 4A.

FIGS. 4A and 4B depict a vane assembly 36 in which the vane coolant tube 24 has been integrally formed to the vane 38. The vane 38 is preferably fin-shaped and has out-stretched mounting posts 40 that are used during assembly of the anode 16. Prior to joining the tube 24 to the vane 38, a channel 42 is machined into a surface 52 of the vane 38, which channel 42 coincides with the shape of the vane coolant tube 24. More precisely, the depth of the channel 42 generally approximates the outer diameter of the vane coolant tube 24. After the vane coolant tube 24 is inserted into the channel 42, the tube 24 is brazed thereto, and braze filler material 44 fills in the interstitial spaces.

The specific process of fabricating a vane is known in the art. Generally, all of the vanes 38 are machined from a single donut shape copper block. Then each vane is sliced from the donut by taking cuts along a radial direction. The vane tip 28 is coated with molybdenum, as mentioned above. Each vane 38 has a generally tapered shape in which the proximal end 50 of the vane is thicker than the vane tip 28.

Having thus described a preferred embodiment of an internally cooled forward wave crossed-field amplifier anode vane, it should now be apparent to those skilled in the art that the aforestated objects and advantages for the within system have been achieved. Although the present invention has been described in connection with the preferred embodiment, it is evident that numerous alternatives, modifications, variations, and uses will be apparent to those skilled in the art in light of the foregoing description. The present invention is further defined by the following claims:

What is claimed is:

1. A crossed-field amplifier, comprising:

an anode and a cathode, said anode being disposed radially along a backwall inside the amplifier and coaxially around said cathode, said anode comprising a plurality of radially disposed vanes having an internal coolant channel; and a means for providing coolant to the internal coolant channel, wherein said coolant channel further comprises a tube disposed in said coolant channel and in fluid communication with said means for providing coolant.

2. The crossed-field amplifier according to claim 1, wherein said tube is substantially U-shaped having two legs joined by an arcuate portion.

3. The crossed-field amplifier according to claim 2, wherein said vanes further comprise a proximal end connected to the backwall, which proximal end contains said two legs of said U-shaped tube.

4. The crossed-field amplifier according to claim 1, wherein said coolant is an ethylene glycol water mixture.

5. The crossed-field amplifier according to claim 1, wherein said tube is made from non-magnetic metal alloy.

6. The crossed-field amplifier according to claim 1, wherein said vane has a fin shape.

7. A double-helix coupled vane for use in an RF slow-wave circuit of a forward wave crossed-field amplifier, said vane comprising:

a fin-shaped body; and a coolant carrying channel disposed in the fin-shaped body, wherein said coolant channel further comprises a tube disposed in said coolant channel and in fluid communication with a coolant source.

8. The double-helix coupled vane according to claim 7, wherein said tube is substantially U-shaped having two legs joined by an arcuate portion.

9. The double-helix coupled vane according to claim 8, wherein said vanes further comprise a proximal end connected to a backwall of said amplifier, which proximal end contains said two legs of said U-shaped tube.

10. The double-helix coupled vane according to claim 7, wherein said coolant is an ethylene glycol water mixture.

11. The double-helix coupled vane according to claim 7, wherein said tube is made from non-magnetic metal alloy.

12. A crossed-field amplifier having a pair of magnetic polepieces providing a magnetic field which crosses an electric field established between a cathode and an anode, said anode being disposed radially along a backwall inside the amplifier and coaxially around the cathode, comprising:

a means for cooling the anode, said anode further comprising a plurality of radially disposed vanes, said cooling means comprising a coolant channel disposed in said vanes; and a coolant source supplying said cooling means external to said backwall, wherein said coolant channel further comprises a tube disposed in said coolant channel and in fluid communication with said coolant source.

13. The crossed-field amplifier according to claim 12, wherein said tube is substantially U-shaped having two legs joined by an arcuate portion.

14. The crossed-field amplifier according to claim 13, wherein said vanes further comprise a proximal end connected to the backwall and a vane tip, said proximal end containing said two legs of said U-shaped tube.

15. The crossed-field amplifier according to claim 12, wherein said coolant is an ethylene glycol water mixture.

16. The crossed-field amplifier according to claim 12, wherein said tube is made from non-magnetic metal alloy.

17. The crossed-field amplifier according to claim 12, wherein said vane has a fin shape with said proximal end being substantially thicker than said vane tip.

* * * * *